US009546854B2

(12) United States Patent
Harris et al.

(10) Patent No.: US 9,546,854 B2
(45) Date of Patent: Jan. 17, 2017

(54) GROUND-PROJECTILE GUIDANCE SYSTEM

(71) Applicants: Gordon L. Harris, Carlsbad, CA (US); Stephen L. Harris, Carlsbad, CA (US)

(72) Inventors: Gordon L. Harris, Carlsbad, CA (US); Stephen L. Harris, Carlsbad, CA (US)

( * ) Notice: Subject to any disclaimer, the term of this patent is extended or adjusted under 35 U.S.C. 154(b) by 0 days.

(21) Appl. No.: 15/069,720

(22) Filed: Mar. 14, 2016

(65) Prior Publication Data

US 2016/0273895 A1 Sep. 22, 2016

Related U.S. Application Data

(63) Continuation of application No. 13/468,864, filed on May 10, 2012, now Pat. No. 9,285,196.

(60) Provisional application No. 61/486,143, filed on May 13, 2011.

(51) Int. Cl.

| | |
|---|---|
| ***F42B 15/01*** | (2006.01) |
| ***F42B 10/64*** | (2006.01) |
| ***F42B 10/06*** | (2006.01) |
| ***F42B 10/26*** | (2006.01) |

(52) U.S. Cl.
CPC ..... *F42B 10/64* (2013.01); *F42B 10/06* (2013.01); *F42B 10/26* (2013.01)

(58) Field of Classification Search
CPC ..... F42B 10/64; F42B 15/01; F42B 10/14; F42B 10/62; F42B 10/06; F42B 10/38; F42B 10/60; F42B 10/16; F42B 10/26; F42B 10/66; F42B 10/02; F42B 10/04; F42B 10/665; F42B 12/362; F42B 25/00; F42B 10/146; F42B 10/18; F42B 10/20
USPC ..... 244/3.21, 3.24; 102/384, 400
See application file for complete search history.

(56) References Cited

U.S. PATENT DOCUMENTS

| | | | | |
|---|---|---|---|---|
| 4,373,688 A | | 2/1983 | Topliffe | |
| 4,561,611 A | * | 12/1985 | Sinclair | F41G 7/222 244/3.16 |
| 4,568,039 A | * | 2/1986 | Smith | F41G 7/222 244/3.15 |
| 5,186,420 A | * | 2/1993 | Beauchamp | B63G 8/18 114/126 |
| 5,235,930 A | * | 8/1993 | Pendleton | B63B 3/08 114/312 |
| 5,393,011 A | * | 2/1995 | Dunn | F42B 10/64 244/3.21 |

(Continued)

FOREIGN PATENT DOCUMENTS

| | | |
|---|---|---|
| DE | 43 35 785 A1 | 4/1995 |
| EP | 0506536 B1 | 5/1995 |

(Continued)

*Primary Examiner* — Brian M O'Hara
*Assistant Examiner* — Assres H Woldemaryam
(74) *Attorney, Agent, or Firm* — Fred C. Hernandez; Mintz Levin Cohn Ferris Glovsky and Popeo, P.C.

(57) ABSTRACT

A guidance unit system is configured to be used for a ground-launched projectile. The system includes a housing configured to be attached to a ground-launched projectile. The housing is coupled to an attachment region that attaches to the projectile, wherein the housing is configure to rotate relative to the attachment region. A motor is contained within the housing and a bearing surrounding the motor. The bearing is rigidly attached to the housing such that the motor rotates with the housing and shields the motor from inertial loads experienced by the housing.

15 Claims, 5 Drawing Sheets

(56) References Cited

U.S. PATENT DOCUMENTS 5,452,864 A * 9/1995 Alford ..... F42B 10/26 244/3.23
7,412,930 B2 * 8/2008 Smith ..... F42B 10/54 102/473
7,475,846 B2 1/2009 Schroeder
7,923,671 B1 4/2011 Huguenin et al.
7,963,442 B2 * 6/2011 Jenkins ..... F41G 7/346 235/400
8,026,465 B1 * 9/2011 Fraysse, Jr. ..... F42B 10/50 244/3.22
8,113,118 B2 * 2/2012 Schmidt ..... F42C 15/26 102/237
8,324,544 B2 * 12/2012 Palani ..... F42B 10/14 244/3.24
8,426,788 B2 * 4/2013 Geswender ..... F42B 10/06 244/3.21
2001/0039898 A1 * 11/2001 Bar ..... F42B 10/50 102/501
2005/0151000 A1 7/2005 Dodu et al.
2008/0001023 A1 * 1/2008 Schroeder ..... F42B 10/14 244/3.24
2008/0006736 A1 * 1/2008 Banks ..... F42B 10/64 244/3.21
2008/0308671 A1 * 12/2008 Harnoy ..... F42B 10/62 244/3.1
2008/0315032 A1 12/2008 Harnoy
2009/0114763 A1 * 5/2009 Geck ..... F42B 10/64 244/3.24
2010/0147992 A1 * 6/2010 Mock ..... F42B 10/64 244/3.22
2010/0275805 A1 * 11/2010 Rastegar ..... F16H 25/02 102/501
2010/0282895 A1 * 11/2010 Geswender ..... F42B 10/14 244/3.29
2011/0073705 A1 * 3/2011 Huguenin ..... F42B 10/64 244/3.24
2011/0180655 A1 * 7/2011 Deschatre ..... F42B 10/64 244/3.28
2011/0285886 A1 * 11/2011 Kato ..... H04N 5/3458 348/297
2014/0312162 A1 * 10/2014 Geswender ..... F42B 15/01 244/3.21

FOREIGN PATENT DOCUMENTS

WO WO-2010016967 A1 2/2010
WO WO-2010039322 A2 4/2010

* cited by examiner

GROUND-PROJECTILE GUIDANCE SYSTEM

REFERENCE TO PRIORITY DOCUMENT

This application is a continuation of U.S. patent application Ser. No. 13/468,864 filed May 10, 2012 issuing on Mar. 15, 2016 as U.S. Pat. No. 9,285,196, which claims priority of U.S. Provisional Patent Application Ser. No. 61/486,143, filed on May 13, 2011. The disclosure of the Provisional patent application is hereby incorporated by reference in its entirety.

BACKGROUND

The present disclosure relates to unguided, ground-launched projectiles and in particular to a system for accurately guiding ground projectiles such as mortar bombs and artillery shells. Many entities manufacture such unguided projectiles in various sizes and forms. Armed forces around the world maintain large inventories of these munitions. By their nature, unguided projectiles are "dumb" in that they are not accurately guided to a target. As a result, successful use of such projectiles is largely dependent on the particular skill and experience level of the person launching the projectile.

SUMMARY

In view of the foregoing, there is a need for a system that can be used to accurately guide ground-launched projectiles such as mortar bombs and artillery shells. Disclosed herein is a device configured to convert an unguided projectile, such as a mortar bomb or artillery shell, into a precision-guided projectile. The device can be used to increase the effective range of a previously unguided projectile and also increase the ability of the projectile to optimally engage a target.

In one aspect, a guidance unit system is configured to be used for a ground-launched projectile. The system includes a housing configured to be attached to a ground-launched projectile. The housing is coupled to an attachment region that attaches to the projectile, wherein the housing is configure to rotate relative to the attachment region. A motor is contained within the housing and a bearing surrounding the motor. The bearing is rigidly attached to the housing such that the motor rotates with the housing and shields the motor from inertial loads experienced by the housing.

Other features and advantages should be apparent from the following description of various embodiments, which illustrate, by way of example, the principles of the invention.

DETAILED DESCRIPTION

Disclosed herein is a device configured to convert an unguided projectile, such as a mortar bomb or artillery shell, into a precision-guided projectile. The device can be used to increase the effective range of a previously unguided projectile and also increase the ability of the projectile to optimally engage a target. In one aspect, the device includes a motor that is shielded from the high loads that are typically experienced by such projectiles during launch and ballistic motion. The motor is advantageously configured to provide proportional actuation of one or more control surfaces (such as canards) of the projectile.

Figure 1:
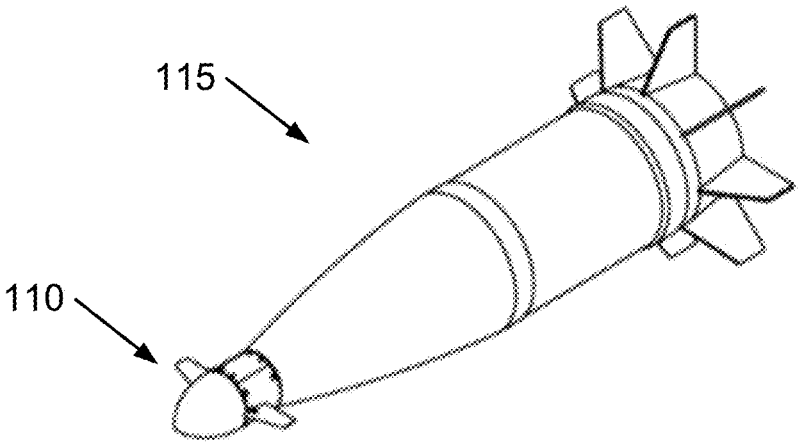
FIG. 1 shows a perspective view of a guidance unit that couples to a projectile.
Figure 2:
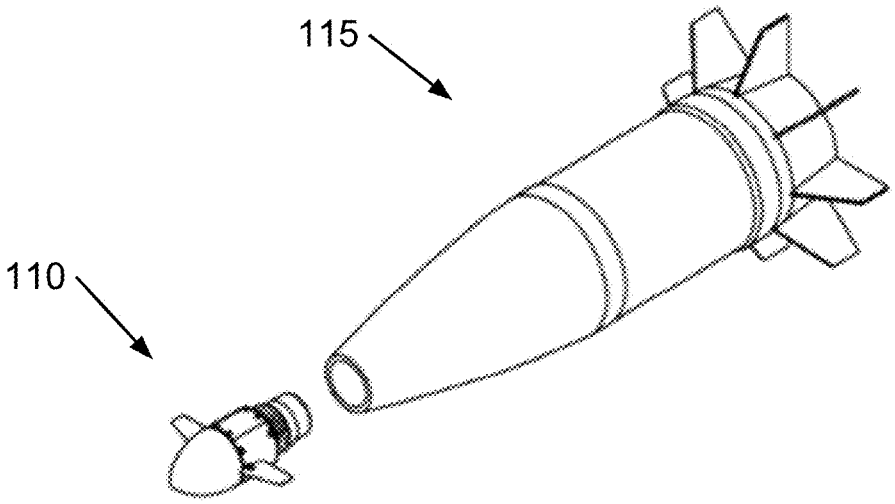
FIG. 2 shows the guidance unit uncoupled from the projectile.

FIG. 1 shows a perspective view of a guidance unit 110 coupled to a ground-launched projectile 115. FIG. 2 shows the guidance unit 110 uncoupled from the projectile 115. The projectile 115 is an unguided projectile in that the projectile itself does not include any components for guiding the projectile 115 to a target. As shown in FIG.2, the guidance unit 110 attaches to the projectile 115 to convert the projectile 115 into a precision-guided projectile, as described in detail below. In the illustrated embodiment, the guidance unit 110 couples to a front-most end of the projectile 115. In this regard, the guidance unit 110 has an outer housing that forms a bullet-nosed tip such that, when coupled to the projectile 115, the guidance unit 110 and projectile 115 collectively form an aerodynamically shaped body. It should be appreciated that the shape of the projectile and of the guidance unit can vary from what is shown in the figures.

The guidance unit 110 may be equipped with a computer readable memory that is loaded with one or more software applications for controlling the guidance of the projectile 115. Moreover, the guidance unit 110 may be equipped with any of a variety of electro-mechanical components for effecting guidance and operation of the projectile. The components for effecting guidance can vary and can include, for example, a global positioning system (GPS), laser guidance system, image tracking, etc. The guidance unit 110 may also include an guidance-integrated fuse system for arming and fusing an explosive coupled to the projectile 115.

The configuration of the projectile 115 may vary. For example, the projectile 115 may be a tail-fin-stabilized projectile (TSP), such as a mortar bomb or artillery shell. Such an embodiment of a projectile includes one or more fins fixedly attached to the tail of the projectile. In another example, the projectile 115 is a spin-stabilized projectile (SSP). It should be appreciated that the projectile 115 may vary in type and configuration.

Figure 3:
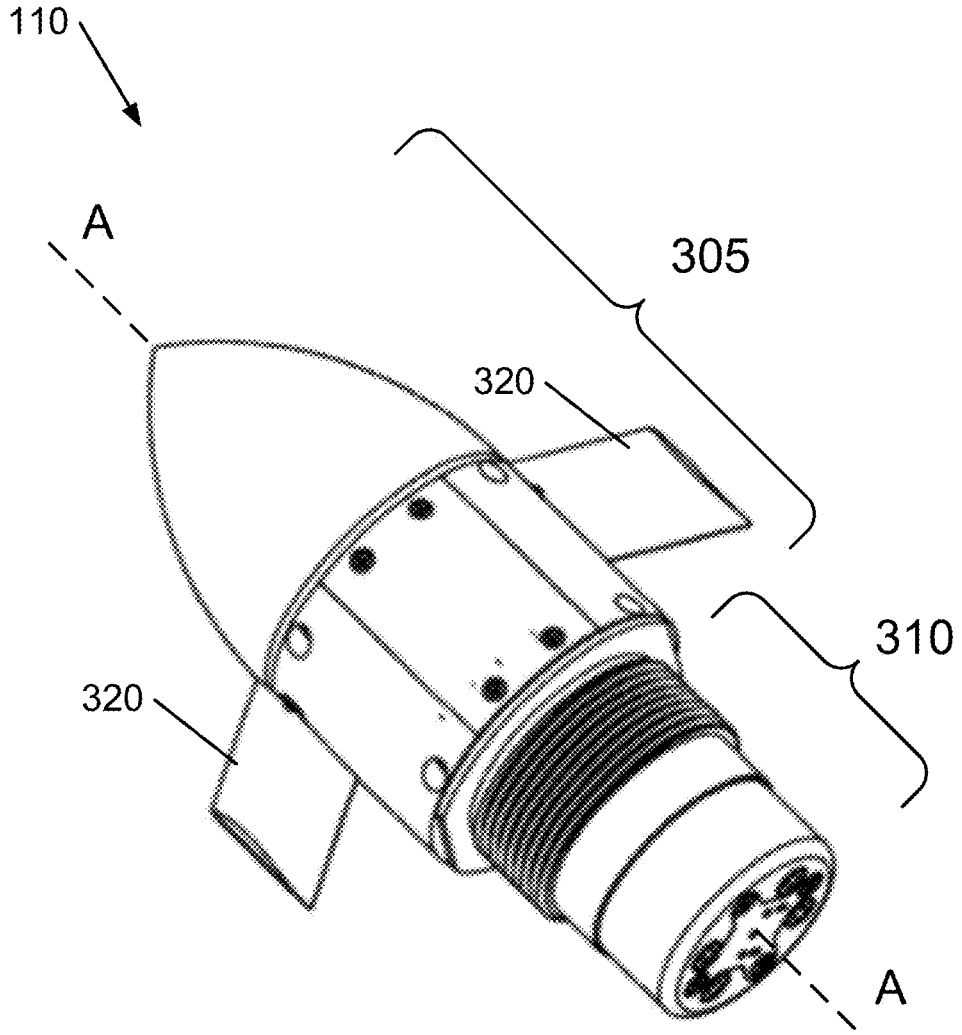
FIG. 3 shows an enlarged view of the guidance unit.

FIG. 3 shows an enlarged view of the guidance unit 110. As mentioned, the guidance unit 110 includes a front housing 305 that forms a bullet-nosed tip although the shape may vary. A coupling region 310 is positioned at a rear region of the guidance unit 110. The coupling region 310 can be coupled, attached, or otherwise secured to the projectile 115 (FIGS. 1 and 2) such as at a front region of the projectile. The front housing 305 and its contents are rotatably mounted to the coupling region 310 such that the housing 305 (and its contents) can rotate about an axis, such as an axis perpendicular to the longitudinal axis A relative to the coupling region 310, as described in detail below. Rotation about other axes, such as about the axis A, are also possible. The longitudinal axis extends through the center of the unit 110. In the illustrated embodiment, the coupling region 310 has outer threads such that the coupling region can be threaded into a complementary threaded region of the projectile 115. It should be appreciated, however, that other manners of coupling the guidance unit 110 to the projectile 115 are within the scope of this disclosure.

Figure 4:
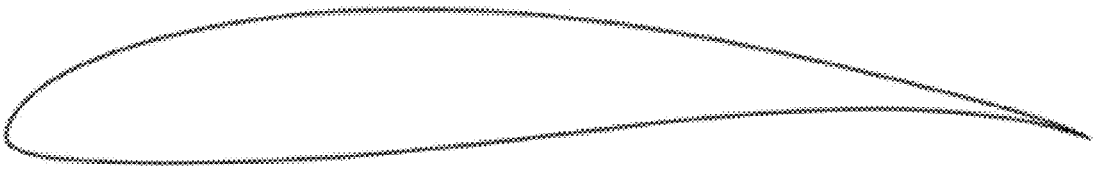
FIG. 4 shows an airfoil shape of a cambered canard.
Figure 5:
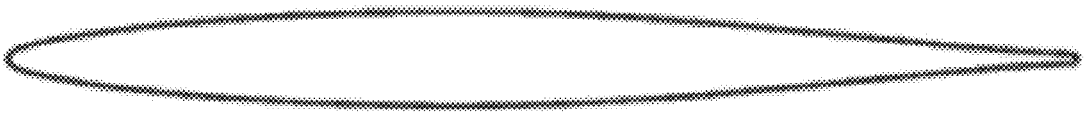
FIG. 5 shows an airfoil shape of a symmetric canard.

With reference still to FIG. 3, two or more control surfaces, such as canards 320, are positioned on the front housing 305 of the guidance unit 110. The canards are configured to be proportionally actuated for accurate guidance of the projectile 115 during use, as described in more detail below. That is, an internal motor in the housing 305 is configured to move the canards in a controlled manner to provide control over a trajectory of the projectile 115. The canards 320 are configured to aerodynamically control the roll and pitch orientation of the projectile 115 with respect to an earth reference frame. In this regard, the canards can be cambered as shown in FIG. 4 or the canards can be symmetric as shown in FIG. 5. The cambered airfoil can be used for mortar bombs and tail-fin-stabilized artillery shells, while for symmetric airfoil can be used for spin-stabilized projectiles. Any of a variety of airfoil configurations are within the scope of this disclosure.

The guidance unit 110 is configured to achieve proportional actuation in a manner that makes the guidance unit 110 capable of surviving the extremely high loads associated with a gun-launched projectile. In this regard, a motor is mounted inside the front housing within a bearing that is rigidly attached to the housing, as described below. The bearing effectively provides an inertial shield over the motor such that the motor is free to rotate relative to the mortar body about the longitudinal axis A. This configuration advantageously reduces or eliminates inertial loads that are experienced during launch and/or flight from being transferred to the motor. Without such an inertial shield, the motor can experience loads during launch that have been shown to increase the likelihood of damage or destruction of the motor.

Figure 6A:
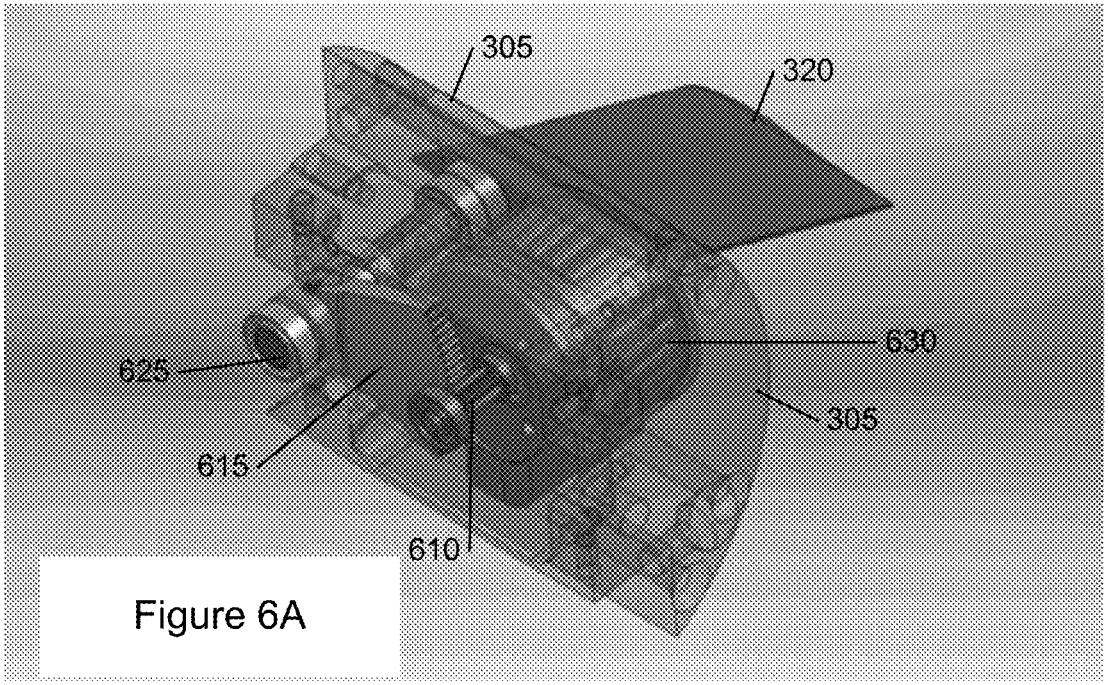
FIGS. 6A and 6B shows a perspective view of a portion of the front housing in partial cross-section.
Figure 6B:
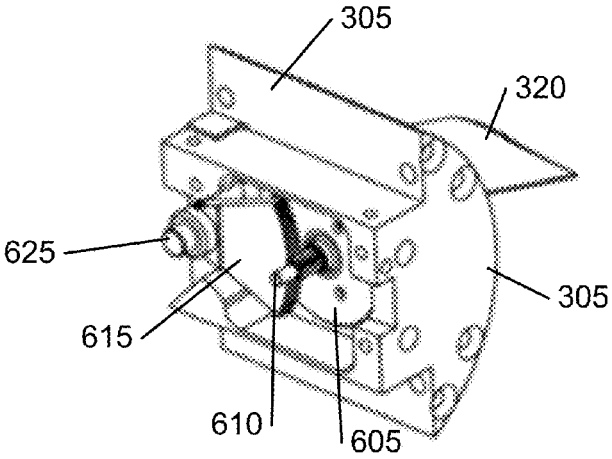

6A shows a perspective view of a portion of the front housing 305 of the guidance unit 110. FIG. 6A shows the guidance unit 110 in partial cross-section with a portion of the device shown in phantom for clarity of reference. FIG. 6B shows the guidance unit in partial cross-section. As discussed above, the canards 320 are mounted on the outer housing 305. A motor 605 is positioned inside the housing 305 within a bearing 630, which shields the motor 605 from inertial loads during launch, as described below. In the illustrated embodiment, the motor 605 is a flat motor although the type of motor may vary. The motor 605 drives a drive shaft 610 by causing the drive shaft 610 to rotate.

The motor 605 is mechanically coupled to the canards 320 via the drive shaft 610 and a geared plate 615. The plate 615 is mechanically coupled to the drive shaft 610 via a geared teeth arrangement. In this manner, the plate 615 translates rotational movement of the drive shaft 610 to corresponding rotational movement of a shaft 625. The shaft 625 is coupled to the canards 320. The motor 615 can be operated to move the canards 320 in a desired manner such as to achieve proportional actuation each canard 320.

With reference still to FIGS. 6A and 6B, the motor 605 is positioned inside a bearing 630 that is rigidly and fixedly attached to the housing 305. That is, the bearing 630 is attached to the housing 305 in a manner such that any rotation of the housing 305 is transferred to the bearing 630. Thus, when the housing 305 rotates, such as a result of loads experience during launch, the bearing also rotates along with the housing 305. However, the motor 630 does not necessarily rotate as the bearing 630 prevents or reduces rotational movement and corresponding loads from being transferred to the motor 630. The bearing arrangement thereby shields the motor 605 from loads on the housing 305 during launch and ballistic movement. It has been observed that the ground-launched projectiles may experience loads on the order of 10,000 to 25,000 during launch. The configuration of the guidance unit advantageously protects the motor against such loads.

Guidance of Tail-Fin-Stabilized Projectile

As mentioned, the guidance unit 110 is configured to provide control over a TSP. In this regards, the guidance unit 110 controls a TSP using roll-to-turn guidance by differentially actuating the canards 320 to achieve differential movement between one canard and another canard on the projectile 115. Such proportional actuation of the canards can be used to achieve a desired roll attitude while collectively actuating the canards to apply a pitching moment to achieve a desired angle of attack and lift. The cambered shape (FIG. 4) of the canard airfoil maximizes the achievable angle of attack. It has been shown that about 8 to 10 degrees of angle of attack yields maximum lift-to-draft ratio, which maximizes the projectile's glide ratio, thereby extending its range.

Guidance of Spin-Stabilized Projectile

Figure 7:
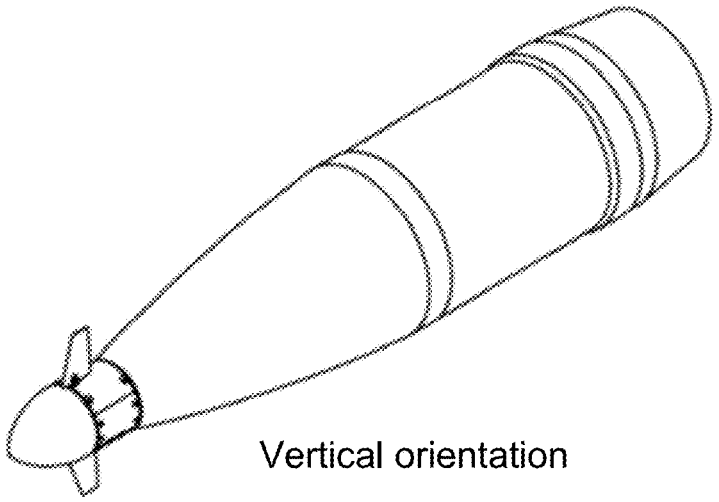
FIG. 7 illustrates how a projectile may be guided by differential deflection of canards.
Figure 7:
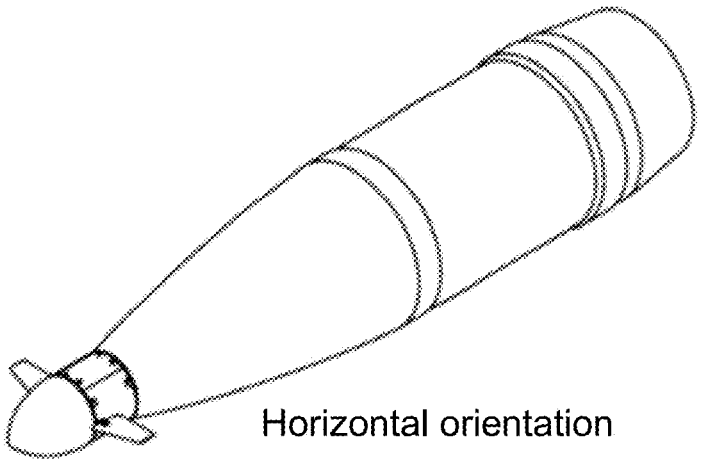

The guidance unit is further configured to provide control over a SSP. The physical hardware of the guidance unit for an SSP can be identical to that used for a TSP. As mentioned, the airfoil profile can also differ between the SSP and TSP. The guidance software used for the SSP guidance may also be configured differently. For guidance of an SSP, the guidance unit 110 is alternately oriented in a vertical and horizontal orientation, as shown in FIG. 7, by differential deflection of the canards. Once the guidance unit is established in one of a vertical or horizontal position, the motor 605 is operated to deflect the canards proportionally to apply the required amount of vertical or horizontal force to steer the projectile in such a manner as to continually keep it aligned along a pre-determined trajectory to the target. The amount of time spent in each of these orientations and the magnitude of the deflection during that period are determined in software according to the detected position and velocity deviations from the desired trajectory.

In use, the projectile 115 with guidance unit 110 is launched from a standard mortar tube. The guidance unit 110 controls its trajectory to the target according to guidance laws that assure optimum use of the available energy imparted at launch to reach maximum range and achieve steep-angle target engagement. It employs roll-to turn guidance to laterally steer to the target and to control the orientation of the unit relative to earth to optimize trajectory shaping in elevation During the ascent and ingress portion of the trajectory, the cambered canards are differentially deflected to establish and maintain the control unit in the upright position (roll angle=0). Collective deflection of the fins serves to cause the mortar bomb to assume an angle of attack corresponding to maximum lift-to-drag ratio, which translates into the flattest glide ratio (distance travelled to height lost) in order to maximally extend the range of the round.

This condition is maintained until the line of sight angle to the target approaches a pre-set target engagement dive angle, at which point the fins are once again differentially deflected to cause the control unit to invert (roll angle=180 degrees) and collectively deflected to cause the round to pitch down at the required angle to the target. Owing to the powerful control afforded by the high-lift cambered fins oriented in the inverted attitude, the pitch-down occurs very rapidly thereby minimizing the time and distance required to achieve the desired steep target engagement angle. Once the desired path angle is achieved, the canards roll the unit to the upright orientation and the round continues to fly to the target with the guidance unit in that attitude.

While this specification contains many specifics, these should not be construed as limitations on the scope of an invention that is claimed or of what may be claimed, but rather as descriptions of features specific to particular embodiments. Certain features that are described in this specification in the context of separate embodiments can also be implemented in combination in a single embodiment. Conversely, various features that are described in the context of a single embodiment can also be implemented in multiple embodiments separately or in any suitable sub-combination. Moreover, although features may be described above as acting in certain combinations and even initially claimed as such, one or more features from a claimed combination can in some cases be excised from the combination, and the claimed combination may be directed to a sub-combination or a variation of a sub-combination. Similarly, while operations are depicted in the drawings in a particular order, this should not be understood as requiring that such operations be performed in the particular order shown or in sequential order, or that all illustrated operations be performed, to achieve desirable results.

Although embodiments of various methods and devices are described herein in detail with reference to certain versions, it should be appreciated that other versions, embodiments, methods of use, and combinations thereof are also possible. Therefore the spirit and endoscope of the appended claims should not be limited to the description of the embodiments contained herein.

The invention claimed is:

1. A guidance unit system for a ground-launched projectile, comprising:

a housing configured to be attached to the ground-launched projectile, the housing having a bullet-nosed region and an attachment region, wherein the attachment region inserts into the ground-launched projectile, wherein the bullet-nosed region of the housing rotates relative to the attachment region of the housing;

at least two canards attached to the housing;

a motor contained within the housing;

a bearing surrounding the motor such that the motor is contained entirely within the bearing, the bearing being rigidly attached to the housing such that the motor rotates with the housing and shields the motor from inertial loads experienced by the housing, wherein the bearing rotates about an axis perpendicular to a long axis of the ground launched projectile.

2. The guidance system of claim 1, wherein the motor is configured to proportionally actuate the canards.

3. The guidance system of claim 2, further comprising a high torque servo-actuator to actuate the canards.

4. The guidance system of claim 1, wherein the canards are cambered.

5. The guidance system of claim 4, wherein the trim at an angle of attack corresponding to a maximum lift-to-drag ratio.

6. The guidance system of claim 1, further comprising a projectile, wherein the projectile includes at least one stabilizing tail.

7. The guidance system of claim 1, wherein the bearing is cylindrical.

8. The guidance system of claim 7, wherein the motor has a drive shaft that is parallel to a long axis of the cylindrical bearing.

9. The guidance system of claim 7, wherein the motor is cylindrical and is nested inside the cylindrical bearing.

10. A projectile guidance assembly, comprising:

a tail stabilized projectile member, the tail stabilized projectile member including at least one fin attached to the tail of the projectile member;

a guidance unit that attaches to the projectile member to convert the projectile member into a precision guided projectile, the guidance unit including:

(a) a front housing having a bullet-nosed region and an attachment region, wherein the attachment region inserts into the precision guided projectile, wherein the bullet-nosed region of the front housing rotates relative to the attachment region of the front housing;

(b) a motor within the front housing; and at least two proportionally-actuated canard control surfaces movably attached to the guidance unit and mechanically coupled to the motor in a manner that permits the proportionally-actuated canard control surfaces to be differentially deflected relative to one another for roll-to-turn steering and deflected collectively for pitch guidance, wherein the guidance unit further includes a bearing surrounding the motor such that the motor is contained entirely within the bearing, the bearing being rigidly attached to the front housing such that the motor rotates with the front housing and shields the motor from inertial loads experienced by the front housing.

11. The projectile guidance assembly as in claim 10, wherein the guidance unit attaches to a front most end of the projectile member.

12. The projectile guidance assembly as in claim 10, wherein the front housing of the guidance unit forms a bullet-nosed tip for the assembly such that the guidance unit and the projectile member collectively form an aerodynamically shaped body.

13. The projectile guidance assembly as in claim 10, wherein the projectile member is a mortar bomb.

14. The projectile guidance assembly as in claim 10, wherein the projectile member is an artillery shell.

15. A projectile guidance assembly, comprising:

a tail stabilized projectile member, the tail stabilized projectile including at least one fin attached to the tail of the projectile;

a guidance unit that attaches to the projectile member to convert the projectile member into a precision guided projectile, the guidance unit including:

(a) a front housing having a bullet-nosed region and an attachment region, wherein the attachment region inserts into the projectile, wherein the bullet-nosed region of the front housing rotates relative to the attachment region of the front housing;

(b) a motor within the housing, wherein the guidance unit further includes a bearing surrounding the motor such that the motor is contained entirely within the bearing, the bearing being rigidly attached to the front housing such that the motor rotates with the front housing and shields the motor from inertial loads experienced by the front housing;

at least two proportionally-actuated canard control surfaces movably attached to the guidance unit and mechanically coupled to the motor in a manner that permits the pair of proportionally-actuated canard control surfaces to be differentially deflected relative to one another for roll-to-turn steering and deflected collectively for pitch guidance.

* * * * *